US008561709B2

(12) United States Patent
Arce et al.

(10) Patent No.: US 8,561,709 B2
(45) Date of Patent: Oct. 22, 2013

(54) LINER TOP PACKER SEAL ASSEMBLY AND METHOD

(75) Inventors: David A. Arce, Houston, TX (US); Sidney K. Smith, Conroe, TX (US)

(73) Assignee: Baker Hughes Incorporated, Houston, TX (US)

( * ) Notice: Subject to any disclaimer, the term of this patent is extended or adjusted under 35 U.S.C. 154(b) by 1324 days.

(21) Appl. No.: 11/734,574

(22) Filed: Apr. 12, 2007

(65) Prior Publication Data

US 2008/0251261 A1 Oct. 16, 2008

(51) Int. Cl.
*E21B 43/10* (2006.01)
*E21B 33/12* (2006.01)

(52) U.S. Cl.
USPC ..... 166/387; 166/208

(58) Field of Classification Search
USPC ..... 166/387, 208, 213, 118
See application file for complete search history.

(56) References Cited

U.S. PATENT DOCUMENTS

| | | | | |
|---|---|---|---|---|
| 2,683,928 | A | | 8/1954 | Carson |
| 3,054,450 | A | | 9/1962 | Baker |
| 3,112,796 | A | | 12/1963 | Myers |
| 3,136,365 | A | | 6/1964 | Carter et al. |
| 3,142,338 | A | | 7/1964 | Brown |
| 3,189,096 | A | | 6/1965 | Phenix |
| 3,256,437 | A | | 6/1966 | Muse |
| 3,282,342 | A | | 11/1966 | Mott |
| 3,289,766 | A | | 12/1966 | Bigelow |
| 3,361,209 | A | | 1/1968 | Edwards, Jr. |
| 3,456,723 | A | | 7/1969 | Current et al. |
| 3,529,667 | A | * | 9/1970 | Malone ..... 166/387 |
| 3,678,998 | A | | 7/1972 | Cockrell et al. |
| 3,976,133 | A | | 8/1976 | Allen |
| 4,044,826 | A | | 8/1977 | Crowe |
| 4,176,715 | A | | 12/1979 | Bigleow et al. |
| 4,216,827 | A | | 8/1980 | Crowe |
| 4,263,968 | A | | 4/1981 | Garner, Jr. |
| 4,285,400 | A | | 8/1981 | Mullins |
| 4,311,195 | A | | 1/1982 | Mullins |
| 4,482,086 | A | | 11/1984 | Wagner et al. |
| 4,506,736 | A | | 3/1985 | Evans |
| 4,834,175 | A | | 5/1989 | Ross et al. |
| 4,923,007 | A | * | 5/1990 | Sanford et al. ..... 277/334 |
| 5,046,557 | A | | 9/1991 | Manderscheid |
| 5,113,939 | A | | 5/1992 | Ross et al. |
| 5,146,983 | A | | 9/1992 | Hromas et al. |
| 5,146,994 | A | | 9/1992 | Pleasants et al. |

(Continued)

OTHER PUBLICATIONS

APEX TM Big Bore Completion Solutions, [online]; [retrieved on Nov. 3, 2006]; retrieved from the Internet http://www.bakerhughesdirect.com/cgi-bin/bot/resources/ExternalFileHandler.jsp?BV_SessionID=@@@@0932326691.11625.

*Primary Examiner* — Brad Harcourt
(74) *Attorney, Agent, or Firm* — Cantor Colburn LLP

(57) ABSTRACT

Disclosed herein is a method of sealing a liner top packer to a tubular. The method includes, positioning the liner top packer within a tubular and moving a sleeve of the liner top packer in a first axial direction thereby radially deforming a first deformable metal member and a second deformable metal member. The method further includes sealably engaging the radially deformed first deformable metal member with a tubular and sealably engaging the radially deformed second deformable metal member with the first deformable metal member and a body of the liner top packer.

21 Claims, 3 Drawing Sheets

(56) References Cited

U.S. PATENT DOCUMENTS

| | | | | |
|---|---|---|---|---|
| 5,211,226 | A | 5/1993 | Hendrickson et al. | |
| 5,358,054 | A * | 10/1994 | Bert | 166/386 |
| 5,810,082 | A | 9/1998 | Jordan, Jr. | |
| 5,988,276 | A | 11/1999 | Oneal | |
| 6,032,958 | A | 3/2000 | Fowler | |
| 6,425,444 | B1 | 7/2002 | Metcalfe et al. | |
| 6,431,282 | B1 | 8/2002 | Bosma et al. | |
| 6,530,574 | B1 | 3/2003 | Bailey et al. | |
| 6,896,049 | B2 | 5/2005 | Moyes | |
| 2003/0217844 | A1 * | 11/2003 | Moyes | 166/118 |
| 2005/0161232 | A1 * | 7/2005 | Patel et al. | 166/386 |

* cited by examiner

LINER TOP PACKER SEAL ASSEMBLY AND METHOD

BACKGROUND OF THE INVENTION

Liner top packers and liner hangers are commonly used together to seal a liner to a downhole tubular such as a casing or another liner. The liner hanger acts as an anchor during the process of setting the liner top packer seals. The liner hanger supports the liner top packer keeping the liner top packer stationary relative to the casing in which it is sealing as a force required to set the liner top packer is applied. Seal integrity and durability are desirable characteristics for such seals, as once set, liner top packer seals are often kept in place for long periods of time, often multiple years.

Typical liner top packer seals incorporate elastomers at the seal interface. Caustic fluids, high temperatures and high pressures encountered downhole often precipitate degradation of elastomeric seals. Degraded seals can develop leaks that can be costly to an operation whether left in place or replaced. When left in place, the quality of a production stream can suffer. When replaced, the cost of equipment and labor as well as costs of lost production, during replacement down-time, will accumulate. Accordingly, there is a need in the art for highly durable liner top packer seals.

BRIEF DESCRIPTION OF THE INVENTION

Disclosed herein is a liner top packer seal system. The seal system includes, a body, a sleeve in radial alignment with the body and a first deformable metal member in operable communication with the sleeve. The operable communication is such that movement of the sleeve in a first direction causes deformation of the first deformable metal member and the first deformable metal member is sealably engagable with a tubular in response to being in a deformed position. The seal system further includes a second deformable metal member in operable communication with the sleeve such that movement of the sleeve in the first direction causes deformation of the second deformable metal member. The second deformable metal member is sealably engagable with both the body and the first deformable metal member in response to being in a deformed position.

Further disclosed herein is a liner top packer seal system. The seal system includes, a body, a sleeve in radial alignment with the body and a first deformable metal member in operable communication with the sleeve such that movement of the sleeve in a first direction causes deformation of the first deformable metal member. The first deformable metal member is sealably engagable with a tubular in response to being in a deformed position. The seal system further includes a second metal member sealably engaged with the body and the first deformable metal member.

Further disclosed herein is a method of sealing a liner top packer to a tubular. The method includes, positioning the liner top packer within a tubular and moving a sleeve of the liner top packer in a first axial direction thereby radially deforming a first deformable metal member and a second deformable metal member. The method further includes sealably engaging the radially deformed first deformable metal member with a tubular and sealably engaging the radially deformed second deformable metal member with the first deformable metal member and a body of the liner top packer.

BRIEF DESCRIPTION OF THE DRAWINGS

The following descriptions should not be considered limiting in any way. With reference to the accompanying drawings, like elements are numbered alike.

DETAILED DESCRIPTION OF THE INVENTION

A detailed description of an embodiment of the disclosed apparatus and method are presented herein by way of exemplification and not limitation with reference to the Figures.

Figure 1:
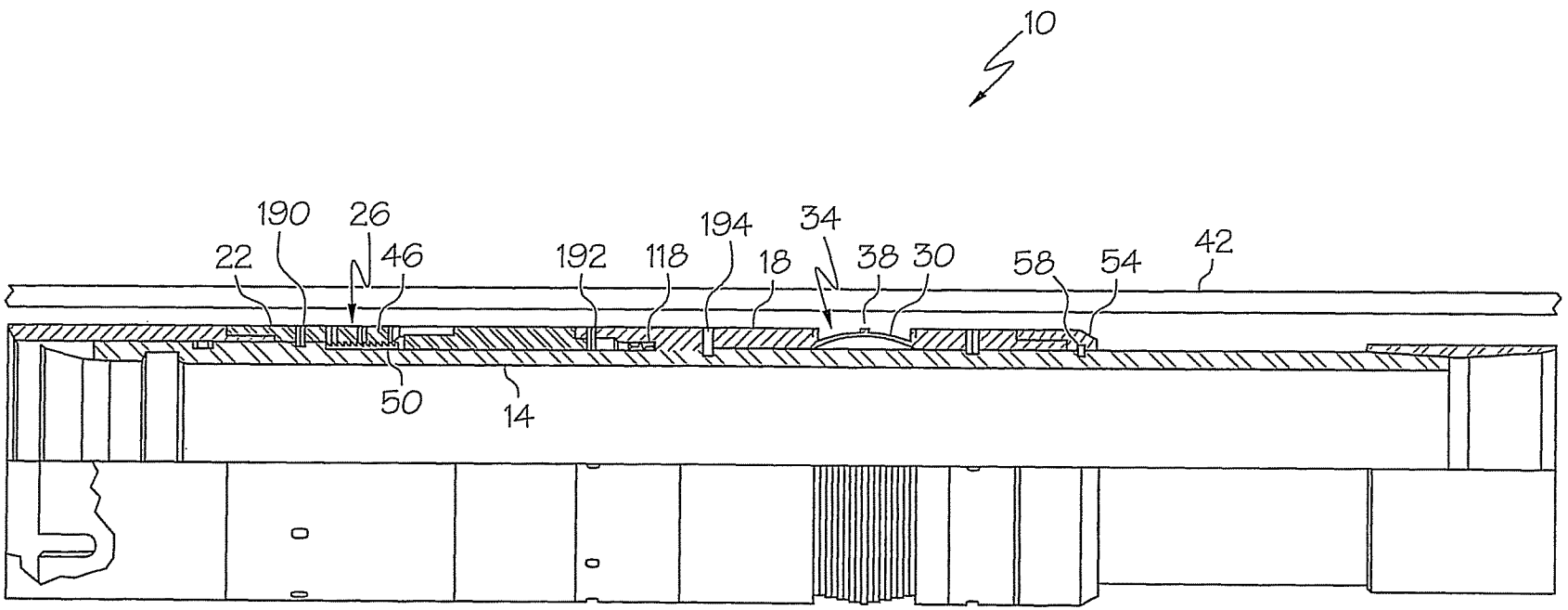
FIG. 1 depicts a partial cross sectional view of a liner top packer seal assembly disclosed herein.

Referring to FIG. 1, an embodiment of the liner top packer seal assembly 10 is illustrated. The liner top packer seal assembly 10 includes a body 14, a first deformable member 18, a sleeve 22 and a ratcheting member 26. The first deformable member 18 and sleeve 22 are in radial alignment with tie body 14. A deformable portion 30 of the first deformable member 18 deforms in response to an axial compression thereof. An axially compressive force can be applied to the first deformable member 18 by axial movement of the sleeve 22 relative to the body 14. The deformable portion 30 is radially extended to a radial dimension that is greater than the largest radial dimension of the first deformable member 18 when the first deformable member 18 is in a non-deformed position 34 (as shown). A contact portion 38 on the deformable portion 30 makes sealable contact with a casing 42, for example, within which the tieback seal assembly 10 is positioned.

The ratcheting member 26 has a movable portion 46, attached to the sleeve 22, and a stationary portion 50, attached to the body 14. The movable portion 46 moves with the sleeve 22 in a downhole direction in this embodiment (although other embodiments could have the sleeve 22 move in an uphole direction) as the sleeve 22 causes the first deformable member 18 to deform as will be shown in detail with reference to FIG. 3. It should be noted that alternate embodiments could instead have the body 14 move while the sleeve 22 remains stationary. The ratcheting member 26 allows movement of the sleeve 22 in the downhole direction and prevents movement of the sleeve 22 in an uphole direction relative to the body 14. In so doing, the ratcheting member 26 locks the first deformable member 18 in a deformed position (not shown). The first deformable member 18 is prevented from moving downhole by a collar 54 shown herein axially fixed to the body 14 by a snap ring 58 that is engagable with the collar 54 and the body 14. Alternate embodiments could have a shoulder or other radially protruding element extending radially outwardly or radially inwardly from the body 14 to prevent the collar 54, or the first deformable member 18 directly, from moving in a downhole direction.

Figure 2:
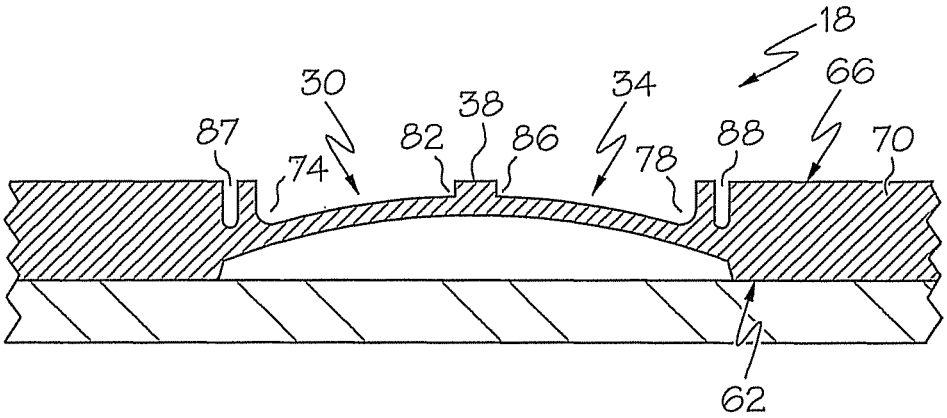
FIG. 2 depicts a magnified partial cross sectional view of a first deformable member of the liner top packer seal assembly of FIG. 1.

Referring to FIG. 2, the first deformable member 18 is deformable from the non-deformed position 34 to the deformed position due to the construction thereof. The deformable portion 30 is formed from a section of the first deformable member 18 that has six lines of weakness, specifically located both axially of the first deformable member 18 and with respect to an inside surface 62 and an outside surface 66 of a wall 70 of the first deformable member 18. In one embodiment, a first line of weakness 74 and a second line of weakness 78 are defined by a change in thickness of the wall 70. A third line of weakness 82 and a fourth line of weakness 86 are defined by a geometrical location of changes in thickness of the deformable portion 30 on either side of the contact portion 38. The four lines of weakness 74, 78, 82, 86 and an arced shape of the deformable member 30 encourage local deformation of the first deformable member 18 to deform radially outwardly. Two additional lines of weakness are formed by first groove 87 and second groove 88. The grooves 87 and 88 are formed in the outer surface 66 axially outwardly of the lines of weakness 74 and 78 respectively. The grooves 87, 88 allow for an increase in magnitude of deformation for the entire deformable portion 30. It should be appreciated that in embodiments where the line of weakness is defined by other than a change in thickness, the radial direction of movement may be the same but caused by the alternate lines of weakness constriction. Further, in such an embodiment, the material that defines a line of weakness will flow or otherwise allow radial movement in the direction indicated. The six lines of weakness 74, 78, 82, 86, 87 and 88 together encourage deformation of the first deformable member 18 in a manner that creates a feature such as the deformed position of the first deformable member 18. The feature is created, then, upon the application of an axially directed mechanical compression of the first deformable member 18 such that the deformable portion 30 is actuated as the first deformable member 18 is compressed to a shorter overall length. Other mechanisms can alternatively be employed to reposition the first deformable member 18 between the non-deformed position 34 and the deformed position. For example, the first deformable member 18 may be repositioned to the deformed position by diametrically pressurizing the first deformable member 18 about the inside surface 62 in the deformable portion 30. Embodiments of the first deformable member 18 can be made of metal, which may have improved resistance to degradation due to exposure to high temperatures, high pressures and caustic fluids often encountered in downhole environments, than conventional sealing elements. Additionally, a seal made with a metal deformable member 18 may have an advantage of increased resistance to swabbing off. Once the first deformable member 18 is deformed due to its length being shortened the ratcheting member 26 can maintain the first deformable member 18 in the shortened condition.

Figure 3:
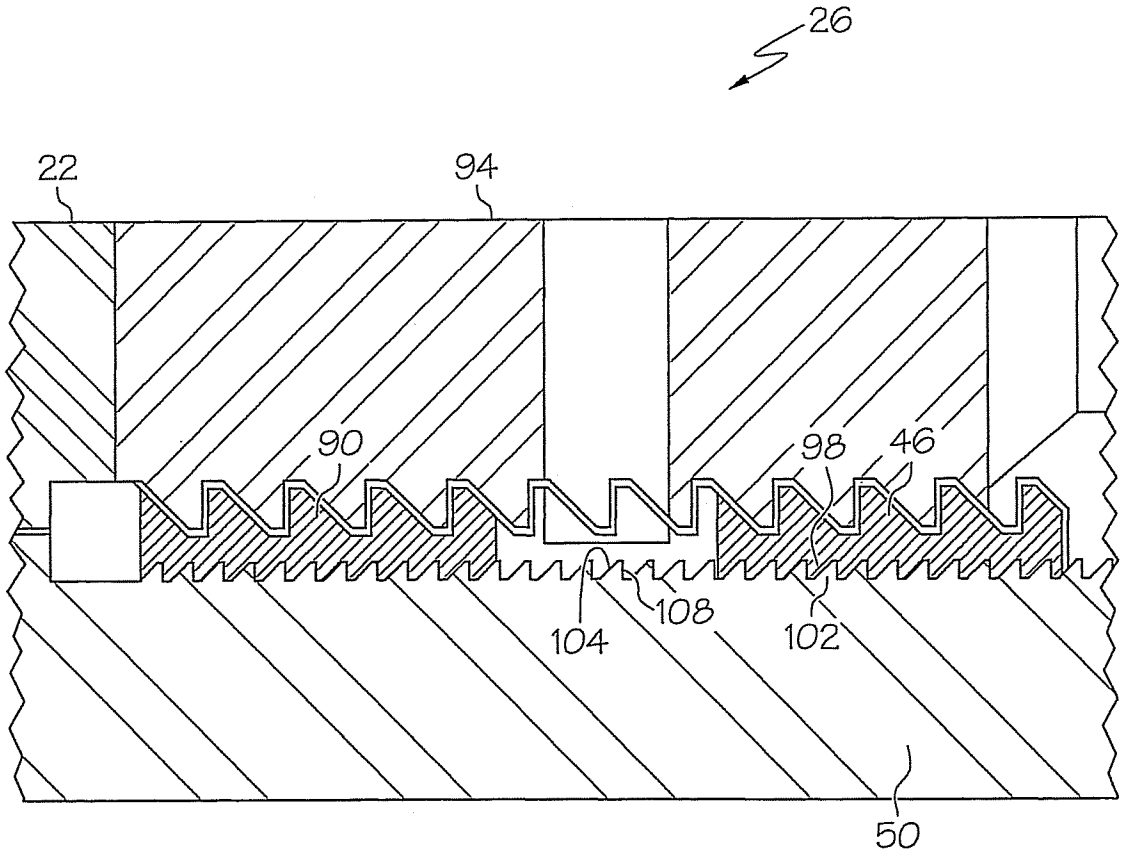
FIG. 3 depicts a magnified cross sectional view of a ratcheting member of the liner top packer seal assembly of FIG. 1.

Referring to FIG. 3 the ratcheting member 26 is illustrated in a magnified partial cross section. The ratcheting member 26 includes the stationary portion 50 and the movable portion 46, which has a body lock ring 90 threadable engaged with a housing 94. The movable portion 46 is housed within the sleeve 22 such that the movable portion 46 is forced to move axially relative to the body 14 whenever the sleeve 22 moves. The movable portion 46 is also able to move radially outwardly as inwardly facing teeth 98 on the lock ring 90 ratchets over outwardly facing teeth 102 on the body 14. The teeth 98, 102 have complimentarily slanted surfaces 104 thereon that permit movement of the lock ring 90, housing 94, movable portion 26 and sleeve 22 relative to the body 14 in a downhole direction as the teeth 98 of the lock ring 90 momentarily disengage and then reengage with the teeth 102 on the body 14. Non-slanted surfaces 108 on the teeth 98, 102 are perpendicular to an axis of the body such that movement of the movable portion 26 in an uphole direction causes the teeth 98, 102 to engage preventing the movable portion 26 from moving in an uphole direction relative to the body 14. The ratcheting member 26 can maintain a second deformable member 118 in a deformed configuration as well.

Figure 4:
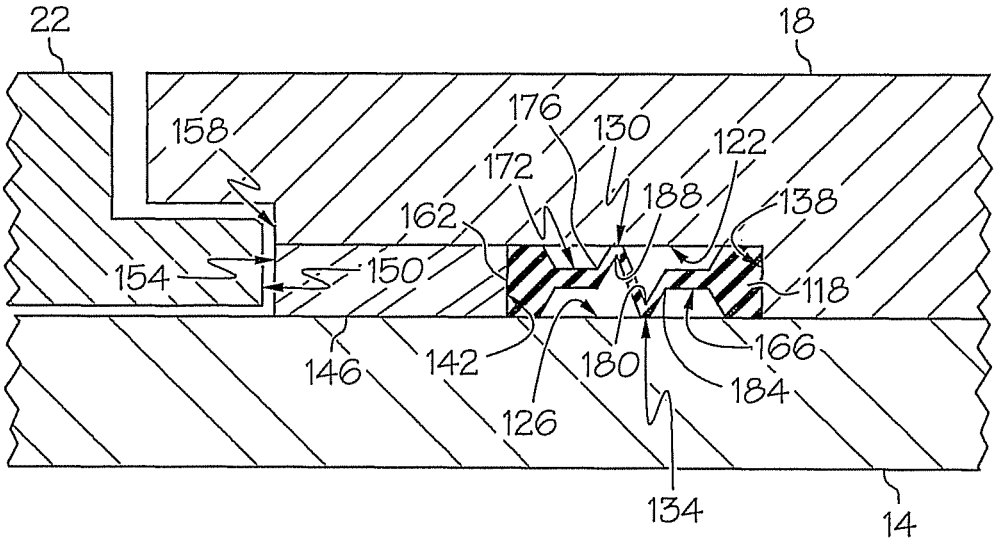
FIG. 4 depicts a magnified cross sectional view of a second deformable member of the liner top packer seal assembly of FIG. 1.

Referring to FIG. 4, the second deformable member 118 is illustrated in magnified partial cross section. The second deformable member 118 is positioned radially between members to which it will be sealed, which in this embodiment are the first deformable member 18 and the body 14. The second deformable member 118 sealably engages with an inner surface 122 of the first deformable member 18 and an outer surface 126 of the body 14 simultaneously. An outwardly deformable portion 130 and an inwardly deformable portion 134 of the second deformable member 118 deform in response to an axial compression of the second deformable member 118. The second deformable member 118 is axially compressed between a first surface 138 of the first deformable member 18 and a second surface 142 of a second sleeve 146 that is radially positioned between the surfaces 122, 126. Movement of the second sleeve 146 results from a surface 150 of the sleeve 22 pushing against a surface 154 of the second sleeve 146. Axial compression of the second deformable member can be limited by controlling the movable distance of the sleeve 22 with a stop surface 158 on the first deformable member 18 against which the surface 150 abuts. The axial compression of the second deformable member 118 causes the outwardly deformable portion 130 to extend radially outwardly a dimension greater than the greatest radially protruding portion of the second deformable member 118 in an undeformed configuration. Similarly, The axial compression of the second deformable member 118 causes the inwardly deformable portion 134 to extend radially inwardly a dimension greater than the smallest radially protruding portion of the second deformable member 118 in an undeformed configuration.

Reconfigurability of the second deformable member 118 between the undeformed configuration and the deformed configuration is effected by and is enabled by the construction thereof. The second deformable member 118 is formed from a tubular member 162 that has four lines of weakness, specifically located both axially of the tubular member 162 and with respect to an inside surface 166 and an outside surface 172 of the tubular member 162. In one embodiment, a first line of weakness 176 and a second line of weakness 180 are defined in this embodiment by diametrical grooves formed in the outside surface 172 of the tubular member 162. A third line of weakness 184 and a fourth line of weakness 188 is defined in this embodiment by a diametrical groove formed in the inside surface 166 of the tubular member 162. The four lines of weakness 176, 180, 184 and 188 each encourage local deformation of the tubular member 162 in a radial direction that tends to cause the groove to close. It will be appreciated that in embodiments where the line of weakness is defined by other than a groove, the radial direction of movement will be the same but since there is no groove, there is no "close of the groove". Rather, in such an embodiment, the material that defines a line of weakness will flow or otherwise allow radial movement in the direction indicated. The four lines of weakness 176, 180, 184 and 188 together encourage deformation of the tubular member 162 in a manner that creates a feature such as the deformed configuration. The feature is created, then, upon the application of an axially directed mechanical compression of the tubular member 162 such that the deformed configuration is formed as the tubular member 162 is compressed to a shorter overall length.

Referring again to FIG. 1, the movement of the sleeve 22 causes both the first deformable member 18 and the second deformable member 118 to deform. Control over when to actuate each of the deformable members 18, 118, however, can be individually controlled in different ways. For example, three shear screws 190, 192, and 194 can be used to establish a specific axial force required to actuate each of the deformable members 18, 118. The first shear screw 190 positioned between the sleeve 22 and the body 14 can be used to set a force threshold at which the ratcheting member 26 becomes loaded. The second shear screw 192 can be positioned between the sleeve 22 and the first deformable member 18, and the third shear screw 194 can be positioned between the first deformable member 18 and the body 14. After the first shear screw 190 has sheared all of the force from the sleeve 22 is transmitted simultaneously through both the second shear screw 192 and the third shear screw 194. As such, whichever of the shear screws 192, 194 is set to shear at a lower force will shear first thereby allowing the force from the sleeve 22 to begin loading the corresponding deformable member 18, 118. If, for example, the second shear screw 192 is set to shear at a lower force than the third shear screw 194, the second deformable member 118 will be actuated by movement of the sleeve 22 before the first deformable member 18. While setting the shear screw forces for the second and third shear screws 192, 194 a designer should keep in mind that the force acting upon whichever shear screw 192, 194 shears last will also be loaded upon the deformable member 18, 118 that is not protected by the remaining shear screw 192 or 194. Optionally, a system could use a single shear screw, such as the first shear screw 190 only, for example, that once sheared would allow both deformable members 18, 118 to be actuated simultaneously. In such a case, control of geometrical and physical parameters of the deformable members 18, 118 relative to one another could be used to control the relative actuation forces between them.

In an alternate embodiment the second deformable member 118 could be deformed during the assembly of the tool 10 prior to running the tool 10 downhole. In this embodiment the second shear screw 192 positionally locks the sleeve 22 to the first deformable member 18 thereby maintaining the second deformable member 118 in the deformed position. Optionally the sleeve 22 could be threadable engaged with the first deformable member 118 to allow rotation therebetween to control axial compression of the second deformable member 118. Once the axial compression of the second deformable member 118 is at the desired level a set screw could be used (for example at the location where the second shear screw 192 is shown) to prevent undesired motion of the threadable engagement. As such, the second deformable member 118 is maintained deformed such that it is sealably and slidably engaged between the body 14 and the first deformable member 18 to allow sealed axial motion therebetween. In this embodiment the third shear screw 194 is not required since the shearing of the first shear screw 190 controls the loading of the first deformable member 18.

While the invention has been described with reference to an exemplary embodiment or embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the claims.

What is claimed is:

1. A liner top packer seal system, comprising:

a body;

a sleeve in radial alignment with the body;

a first deformable metal member in operable communication with the sleeve such that movement of the sleeve along its longitudinal axis in a first direction causes deformation of the first deformable metal member, the first deformable metal member being sealably engagable with a tubular in response to being in a deformed position; and a second deformable metal member in operable communication with the sleeve such that movement of the sleeve along its longitudinal axis in the first direction causes deformation of the second deformable metal member, the second deformable metal member occluding an annular space between the body and the first deformable metal member, and being sealably engagable with both the body and the first deformable metal member in response to being in a deformed position.

2. The liner top packer seal system of claim 1, wherein the first deformable metal member further comprises at least two circumferential lines of weakness.

3. The liner top packer seal system of claim 2, wherein the circumferential lines of weakness are changes in thickness of walls of the deformable member.

4. The liner top packer seal system of claim 1, wherein a portion of the first deformable metal member when in the deformed position extends radially outwardly a greater dimension than the first deformable metal member extends when in a non-deformed position.

5. The liner top packer seal system of claim 1, wherein the second deformable metal member further comprises:

at least one circumferential line of weakness near an inside surface thereof; and at least one circumferential line of weakness near an outside surface thereof.

6. The liner top packer seal system of claim 5, wherein the circumferential lines of weakness are changes in thickness of walls of the second deformable metal member.

7. The liner top packer seal system of claim 5, wherein the circumferential lines of weakness are grooves in walls of the second deformable metal member.

8. The liner top packer seal system of claim 5, wherein a first portion of the second deformable metal member when in the deformed position extends radially outwardly a greater dimension than the second deformable metal member extends when in a non-deformed position, and a second portion of the second deformable metal member when in the deformed position extends radially inwardly a smaller dimension than the second deformable metal member extends when in a non-deformed position.

9. The liner top packer seal system of claim 8, wherein a first portion is sealably engagable with the first deformable metal member when in the deformed position and the second portion is sealably engagable with the body when in the deformed position.

10. The liner top packer seal system of claim 1, further comprising a ratcheting member in operable communication with the body and the sleeve such that the sleeve is movable in the first direction relative to the body and is not movable in a second direction that is opposite that of the first direction.

11. The liner top packer seal system of claim 10, wherein the ratcheting member further comprises:

at least one first ratchet portion in operable communication with the sleeve having a plurality of teeth; and at least one second ratchet portion in operable communication with the body having a plurality of teeth, the teeth of the at least one first ratchet portion engagable with the teeth of the at least one second ratchet portion such that the sleeve can move in the first direction and not in the second direction.

12. The liner top packer seal system of claim 1, further comprising a collar attached to the body in operable communication with at least one of the deformable metal members such that the collar prevents a portion of the at least one deformable metal member in functional communication therewith from moving relative to the body.

13. The liner top packer seal system of claim 1, further comprising at least one force failing member in operable communication with at least one of the deformable metal members such that the at least one deformable metal member in operable communication therewith remains unloaded by movement of the sleeve when the force failing member has not failed.

14. The liner top packer seal system of claim 13, wherein at least one of the at least one force failing members is a shear screw.

15. The liner top packer seal system of claim 1, further comprising:

a first force failing member in operable communication with the first deformable metal member, the first force failing member preventing the first deformable metal member from being loaded by sleeve movement when the first force failing member has not failed, and a second force failing member in operable communication with the second deformable metal member, the second force failing member preventing the second deformable metal member from being loaded by sleeve movement when the second force failing member has not failed.

16. A liner top packer seal system, comprising:

a body;

a sleeve in radial alignment with the body;

a first deformable metal member in operable communication with the sleeve such that movement of the sleeve along its longitudinal axis in a first direction causes deformation of the first deformable metal member, the first deformable metal member being sealably engagable with a tubular in response to being in a deformed position; and a second deformable metal member positionable in an annular space between the body and the first deformable metal member being sealably engagable with the body and the first deformable metal member in response to being in a deformed position.

17. A method of sealing a liner top packer to a tubular, comprising:

positioning the liner top packer within a tubular;

moving a sleeve of the liner top packer in a first longitudinal axial direction;

radially deforming a first deformable metal member and a second deformable metal member with the movement of the sleeve;

occluding an annular space defined between a tubular and the first deformable metal member;

sealably engaging the radially deformed first deformable metal member with the tubular; and sealably engaging the radially deformed second deformable metal member with the first deformable metal member and a body of the liner top packer in an annular space between the first deformable metal member and the body.

18. The method of sealing the liner top packer to a tubular of claim 17, further comprising engaging a ratcheting member in operable communication with the sleeve and the body to allow movement of the sleeve in the first direction while preventing movement of the sleeve in a second direction that is opposite that of the first direction.

19. The method of sealing the liner top packer to a tubular of claim 17, further comprising positioning a plurality of circumferential lines of weakness on the first and the second deformable metal members to control the radial deformations thereof.

20. The method of sealing the liner top packer to a tubular of claim 17, further comprising altering wall thicknesses of the first and the second deformable metal member to create circumferential lines of weakness thereon.

21. The method of sealing the liner top packer to a tubular of claim 17, further comprising radially deforming the first deformable metal member radially outwardly and radially deforming the second deformable metal member radially inwardly and radially outwardly.

* * * * *